US006132002A

United States Patent [19]

Brown, II

[11] Patent Number: 6,132,002

[45] Date of Patent: Oct. 17, 2000

[54] COMBINATION ELEVATED SEAT AND BOOT JACK

[75] Inventor: Austin E. Brown, II, Beeville, Tex.

[73] Assignee: Brown Ranch Group, L.L.C., San Antonio, Tex.

[21] Appl. No.: 09/295,979

[22] Filed: Apr. 21, 1999

[51] Int. Cl.[7] ..... A47C 16/02

[52] U.S. Cl. ..... 297/423.41; 297/423.4; 297/440.13; 297/451.4; 297/423.14

[58] Field of Search ..... 297/423.14, 423.17, 297/423.39, 423.4, 423.41, 440.13, 451.4, 451.5; 223/115, 114; D2/642

[56] References Cited

U.S. PATENT DOCUMENTS

| | | | |
|---|---|---|---|
| 231,529 | 8/1880 | Boyington | 297/423.4 X |
| 235,054 | 11/1880 | Gatrell | 223/115 |
| 315,507 | 4/1885 | Jenkins | 297/423.14 |
| 375,954 | 1/1888 | Robb | 297/423.14 |
| 505,083 | 9/1893 | Ausman | 297/423.14 |
| 967,452 | 8/1910 | Silverman | 297/423.21 X |
| 2,102,261 | 12/1937 | Fotre | 297/423.14 |
| 2,177,174 | 10/1939 | Eccles | 297/423.4 |
| 2,603,814 | 7/1952 | Weber | 297/423.4 X |
| 2,658,225 | 11/1953 | Bascom | 297/423.14 |
| 3,244,389 | 4/1966 | Wilkins | 297/423.4 X |

FOREIGN PATENT DOCUMENTS

| | | | |
|---|---|---|---|
| 2664800 | 1/1992 | France | 297/423.4 |
| 219889 | 3/1910 | Germany | 223/114 |
| 721691 | 6/1932 | Germany | 223/115 |
| 145933 | 6/1931 | Switzerland | 297/423.4 |

*Primary Examiner*—Peter M. Cuomo
*Assistant Examiner*—David E. Allred
*Attorney, Agent, or Firm*—Jackosn Walker L.L.P.

[57] ABSTRACT

A combination elevated seat and boot jack having a base member with at least one boot removal notch. An upright pedestal supports the seat in an elevated position. The width of the platform of the base is sufficient to improve stability of the user of the jack.

6 Claims, 1 Drawing Sheet

COMBINATION ELEVATED SEAT AND BOOT JACK

BACKGROUND OF THE INVENTION

The present invention relates to a combination single pedestal seat and a boot jack mechanism. It is well known that certain boots are difficult to remove. Such boots normally do not have laces or straps to facilitate removal from the wearer's foot. Boot jacks exist which are designed to allow the upper portion of the heel of the boot to slide or fit into a notch in a slanted platform raised above the bottom of the boot heel. The user steps on the slanted platform with the opposite foot to hold the jack firmly against the ground or floor while pulling his leg upwardly to slide his foot from the boot having its heel in the jack notch. Often times it requires considerable effort to pull one's foot from the boot with the standard jack, particularly a jack having a narrow platform.

Pulling a boot on is often accomplished by balancing on one leg while pulling the boot on to the opposite foot. Alternatively, one can sit on a chair or bench but the standard seat is often low (approximately 18" from floor level). Putting or dorming on the boot may require considerable tight bending in an unbalanced position. The combination of the present invention solves these difficulties.

SUMMARY OF THE INVENTION

The present invention is a combination elevated seat boot jack. A base member has a slanted platform with one side elevated by lifting feet to enable the upper portion of a boot heel to be inserted and held within a boot removing notch while the user is standing on the platform. A vertical pedestal extends upwardly from the platform. The pedestal is provided with a seat to support the user when pulling the boots back on his or her feet or for leaning against when removing the boot. The seat is elevated above the standard chair seat or bench seat height of 18"–20". The platform is further provided with additional boot removal notches. The base member has feet spaced apart more than 12" to provide stability for the platform when a boot is being removed.

DETAILED DESCRIPTION OF THE PREFERRED EMBODIMENT

Figure 1:
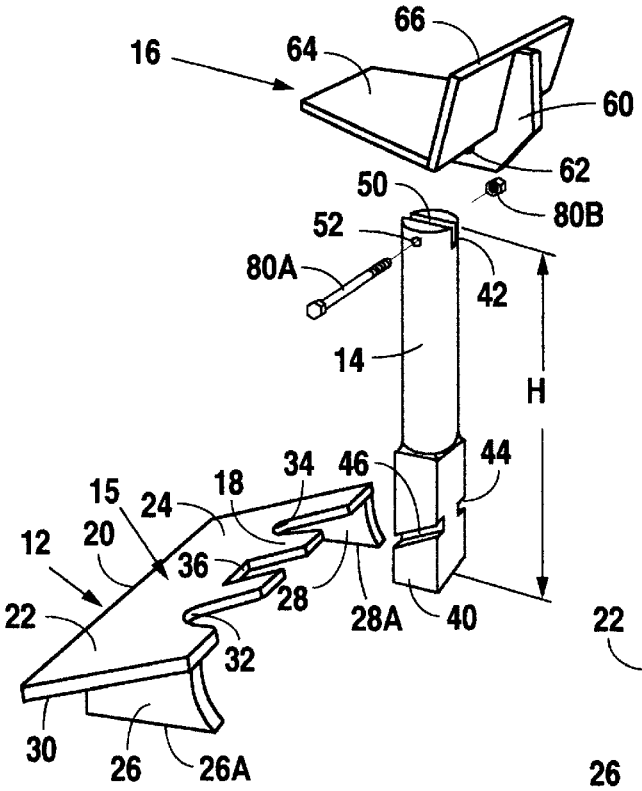
FIG. 1 shows an exploded perspective of the present invention.
Figure 3:
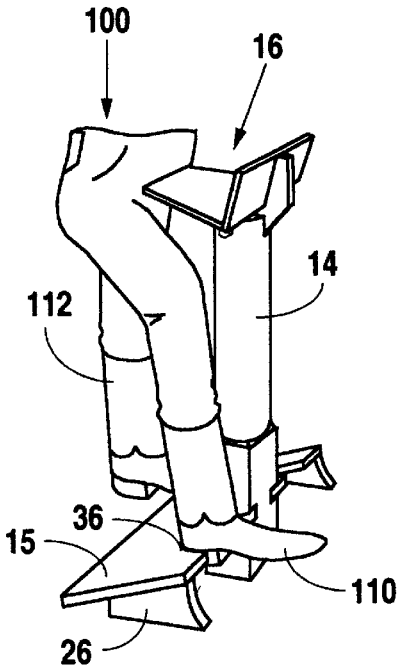
FIG. 3 provides a perspective view of the present invention assembled and a user pulling off his boot.

FIG. 1 illustrates the three major components of the combination of the present invention 10. A base member 12 is provided with a releasably attachable vertical pedestal 14, and an elevated horizontal support member or seat 16. The base member 12 has a slanted platform 15 with a first side 18 and a second side 20, a third side 22, and a fourth side 24. Two feet 26 and 28 are attached to the under surface 30 at the first side of the platform 15. These feet 26 and 28 elevate the first side 18 and allow a boot heel to fit beneath (as seen in FIG. 3). The first side of the platform is provided with one or more boot receiving notches 32 and 34 and a pedestal receiving notch 36.

Figure 2:
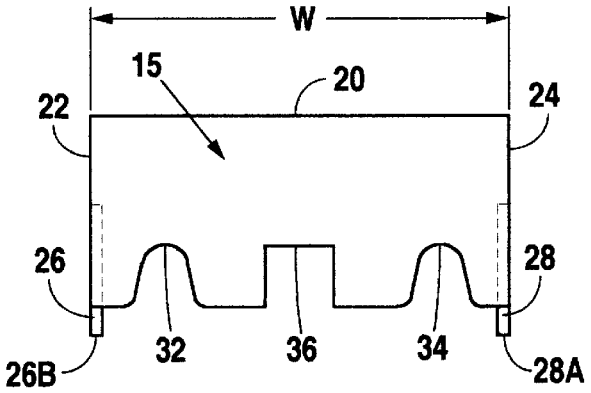
FIG. 2 illustrates a top plan view of the platform of the present invention.

Opposite third 22 and fourth 24 sides (which are generally perpendicular to first and second sides 18 and 20) are spaced apart by a width W of more than 12". This width W provides stability for the platform 15 when boots are being pulled off and the user has his or her opposite foot on the top surface of the platform. In existing boot jacks the platform is normally relatively narrow, i.e., less than 12" wide and this requires the user to put his or her feet close together when pulling the boot off. This creates imbalance, making the task more difficult. With the present invention the user may spread his or her feet apart more than 12" and stand with one foot on the top of the platform while the heel of the other foot is held in the boot removing notch as seen in FIG. 3. FIG. 2 shows a top plan view of the base member 12.

Pedestal 14 has a base end 40 and a top end 42. The pedestal has a height H sufficient to place seat 16 twenty-four to thirty-six inches above the bottom of feet 26 and 28. The base 40 is provided with channels 44 and 46 on opposite sides of the pedestal 14. The channels are sized and aligned to cooperate with the pedestal receiving notch 36 in base member 12. The pedestal is slid into notch 36 with the channels 44 and 46 in alignment with the notch 36. This holds the pedestal 14 in releasable engagement with the base member 12 with the platform 15 extending inwardly from the pedestal 14. The pedestal 14 is thus disposed between and transversely aligned with the boot receiving notches 32 and 34. Removal of the pedestal facilitates transport and storage of the device 10.

Top end 42 of pedestal 14 has a diametrical slot 50 and a fastener opening 52. The slot is sized to receive and retain the support bracket 60 of horizontal support member or seat 16. The bracket 60 has a fastener opening 62 which aligns with opening 52 in the pedestal and receives fastener 80A (nut 80B is provided to secure the support member 16 to the pedestal 14). Other attachment means for the seat to pedestal fixation could include a seat stem insertable into a top orifice in the pedestal, or a clamping collar mechanism well known in the seat art.

The seat 16 has a generally flat top surface 64 and may be provided with an upright back rest 66. The surface 64 is in the range of 24"–36" above the bottom surface 26A and 28A of the bottom of feet 26 and 28. The seat 16 extends inwardly above the platform 15 such that the user 100 may don the boot 110 while sitting on the seat 16 with the boot 110 resting on the platform 15 (FIG. 14).

FIG. 3 illustrates a user 100 removing a boot 110. Boot 110 is engaged in notch 36 while the user 100 stands placing his other boot 112 on the platform 15. The user 100 may steady himself by holding the upper horizontal support 16 on pedestal 14. Further, because of the width of the platform 15, the user can space his feet apart more than 12" and still hold the platform stable while pulling his leg and foot out of the boot 110.

Figure 4:
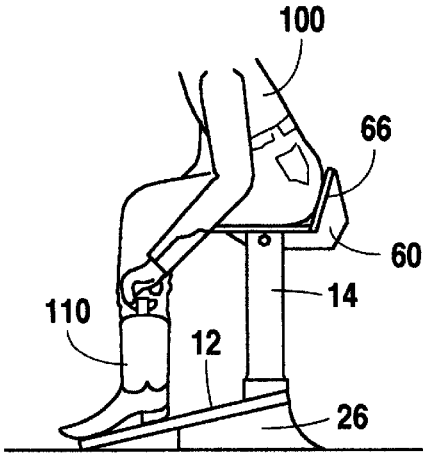
FIG. 4 illustrates the use of the elevated seat of the present invention.

FIG. 4 shows the elevated seat 16 atop the pedestal while the user pushes or pulls on boot 110. The user does not have to bend over too tightly or does not have to balance on one foot to don the boot. The seat is elevated above the normal or standard height of a chair or bench seat. Platform 12 provides a comfortable, flat surface to steady the user 100 and support the pedestal.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

What is claimed is:

1. A combination seat and jack for removal and donning of a user's boot comprising:

a base member having spaced apart feet and a slanted platform, said feet positioned beneath a first side of said platform elevating said first side above a second side of said platform, said first side of said platform providing two boot receiving notches to facilitate said removal of said boot while said user is standing on said platform;

a pedestal having a first end and a second end, said pedestal having slanted slots in its first end, said slots releasably attached by engaging a third notch in said first side of said platform to support said pedestal on said platform, said platform extending inwardly from said first pedestal end, said pedestal disposed between and transversely aligned with said notches and extending vertically from said first side of said platform and above said notches; and an upper horizontal seat attached to and extending inwardly from said second end of said pedestal such that said user may don said boot while sitting on said seat with said boots resting on said platform.

2. The combination of claim 1 wherein said platform has a pedestal receiving notch on said first side of said platform.

3. The combination of claim 2 wherein said first end of said pedestal has an attachment member which cooperates with said pedestal receiving notch to removably attach said pedestal to said platform.

4. The combination of claim 1 wherein said upper horizontal seat further comprises a generally upwardly projecting back rest member.

5. The combination of claim 1 wherein said upper horizontal seat is in the range of 24" to 36" above a bottom surface of said feet.

6. The combination of claim 1 wherein said platform has a third and a fourth side perpendicular to said first and said second side, said third and said fourth side spaced apart more than 12".

* * * * *